United States Patent [19]

Fisher et al.

[11] Patent Number: 5,051,761

[45] Date of Patent: Sep. 24, 1991

[54] INK JET PRINTER HAVING A PAPER HANDLING AND MAINTENANCE STATION ASSEMBLY

[75] Inventors: Almon P. Fisher; Herman H. Hermanson, both of Rochester, N.Y.

[73] Assignee: Xerox Corporation, Stamford, Conn.

[21] Appl. No.: 520,740

[22] Filed: May 9, 1990

[51] Int. Cl.[5] ..... B41J 2/165

[52] U.S. Cl. ..... 346/140 R

[58] Field of Search ..... 346/75, 140

[56] References Cited

U.S. PATENT DOCUMENTS

| | | | |
|---|---|---|---|
| 4,144,537 | 3/1979 | Kimura et al. . | |
| 4,207,578 | 6/1980 | Marinoff | 346/75 |
| 4,369,456 | 1/1983 | Cruz-Uribe et al. . | |
| 4,437,105 | 3/1984 | Mrazek et al. . | |
| 4,463,359 | 7/1984 | Ayata et al. . | |
| 4,571,599 | 2/1986 | Rezanka . | |
| 4,829,324 | 5/1989 | Drake et al. . | |
| 4,853,717 | 8/1989 | Harmon et al. . | |
| 4,947,191 | 8/1990 | Nozawa | 346/140 |
| 4,952,947 | 8/1990 | Kyoshima | 346/140 |

FOREIGN PATENT DOCUMENTS 59-115863 7/1984 Japan .

*Primary Examiner*—Joseph W. Hartary
*Attorney, Agent, or Firm*—Oliff & Berridge

[57] ABSTRACT

A paper-handling and maintenance station assembly for use in an ink jet printer is described. A paper-handling loop is included in a paper conveying system. The loop has at least one opening therein. A rotatable maintenance station has a plurality of members positioned about the circumference thereof, each member performing a different maintenance function. The maintenance station can be provided within an area enclosed by the loop and can be moved in an axial direction to engage a printhead which can be fixedly positioned at a location exterior to the loop enclosed area. The opening in the loop allows the engagement between the maintenance station and printhead.

20 Claims, 2 Drawing Sheets

INK JET PRINTER HAVING A PAPER HANDLING AND MAINTENANCE STATION ASSEMBLY

BACKGROUND OF THE INVENTION

1. Field of the Invention

The present invention relates to an ink jet printer, and, more particularly, to an ink jet printer having a paper handling assembly and a maintenance station assembly for contacting the printhead.

2. Description of the Related Art

Ink jet printing systems can generally be divided into two types: one type using thermal energy to produce a vapor bubble in an ink filled channel that expels a drop of ink; or another type using a piezoelectric transducer to produce a pressure pulse that expels a droplet from a nozzle.

Thermal ink jet printing systems use thermal energy selectively produced by resistors located in capillary-filled ink channels near channel terminating nozzles or orifices to vaporize momentarily the ink and form bubbles on demand. Each temporary bubble expels an ink droplet and propels it towards a recording medium. The printing system may be incorporated in either a carriage-type printer or a pagewidth type printer. The carriage-type printer generally has a relatively small printhead containing the ink channels and nozzles. The printhead is usually sealingly attached to a disposable ink supply cartridge and the combined printhead and cartridge assembly is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. For an example of a carriage-type printer, refer to U.S. Pat. No. 4,571,599 to Rezanka. In contrast, the pagewidth printer has a stationary printhead having a length equal to or greater than the width of the paper. The paper is continually moved past the pagewidth printhead in a direction normal to the printhead length and at a constant speed during the printing process. Refer to U.S. Pat. No. 4,463,359 to Ayata et al for an example of a pagewidth printhead. Refer to U.S. Pat. No. 4,829,324 to Drake et al (the disclosure of which is herein incorporated by reference) for another example of a pagewidth printhead.

Piezoelectric activated ink jet printing systems use a pulse generator which provides an electric signal. The signal is applied across crystal plates, one of which contracts and the other of which expands, thereby causing the plate assembly to deflect toward a pressure chamber. This causes a decrease in volume which imparts sufficient kinetic energy to the ink in the printhead nozzle so that one ink droplet is ejected onto a recording medium. Refer to U.S. Pat. No. 4,144,537 to Kimura et al for an example of a piezoelectric activated ink jet printer.

In the ink jet printing systems of the above-types, several problems have arisen which adversely affect the quality and performance of printing. Among these problems are 1) clogging of the printhead nozzle caused by ink drying therein due to non-use for a period of time; 2) adherence of dust to the face of the nozzle due to the moisture of fluid ink around the nozzle; 3) leakage of ink from the nozzle; 4) bubbles and dust taken into the printhead nozzle as a result of external causes such as vibration imparted to the printhead and environmental change occurring around the printhead; and 5) contamination of the printhead nozzles when the printhead is not in use such contaminating being, for example, non-collapsing air bubbles.

Several approaches have been proposed which address the aforementioned problems.

U.S. Pat. No. 4,437,105 to Mrazek et al discloses a cassette comprising a capping and cleaning device for the cleaning of an ink jet printhead. The device is operated by moving the printhead into a position in front of a capping window or cleaning window, depending on which function is required. The cassette is then displaced until contact is made between the printhead and the cleaning member or capping member. The cassette may also house a purging position which can collect ink from the printhead during a purging operation and a scraper for scraping off ink from the printhead surface.

U.S. Pat. No. 4,144,537 to Kimura et al discloses a method and apparatus for capping a nozzle of an ink jet recording device. The capping member is located at a position away from (along side of) the printing area. When printing is not being performed, the printhead is moved to this position and is capped. A spring and cam mechanism is used to position the capping member in engagement with the printhead nozzle.

U.S. Pat. No. 4,853,717 to Harmon et al discloses a service station for an ink jet printer comprising a pump for priming a printhead, a sled to actuate the service station and seal the printhead, and a wiping member for cleaning the printhead. The service station cleans clogged nozzles, covers the nozzles with a protective cap when not in use and wipes contaminants from the nozzles. The service station is used with a carriage-type printhead and is fixed at one end of travel of the printhead.

U.S. Pat. No. 4,369,456 to Cruz-Uribe et al discloses a cleaning device for writing heads of an ink jet printer. The apparatus comprises rotatable supply and takeup reels, a movable absorbent cleaning belt including a plurality of embossed elements and a plurality of openings for allowing printing on a paper medium. The cleaning apparatus performs its functions while the printhead remains stationary.

The above-discussed devices attempt to overcome the shortcomings associated with the use of ink jet nozzles With the exception of U.S. Pat. No. 4,369,456, however, all of the devices require movement of the printhead from its operative position for maintenance to be performed thereon. This movement is undesirable as it requires additional moving parts. Such systems are particularly undesirable for use with a full width (pagewidth) printhead. This type of printhead should be held fixed because it is quite large and cumbersome. Additionally, since most of the above-mentioned patents locate the maintenance system adjacent the paper conveying system (e.g., a platen) and require the printhead (which is a carriage-type printhead) to be moved alongside of the paper conveying system, they cannot be practically used with a full width printhead since the printer would have to be made exceptionally wide. Further, since it is required to locate the printhead close to the paper medium for improvement of print quality, it is difficult to locate a maintenance system between the printhead and the paper conveying system. Since both the pagewidth printhead and paper conveying system are large, it is not desirable to move them apart from one another to allow a maintenance system to access the printhead. In the thermal ink jet printhead, and, in particular, the four-color thermal ink jet printhead, heat management often requires a large costly heat transfer unit (heatsink) to dissipate the heat out of the printhead. The use of a fixed printhead would serve to simplify the electrical connections thereto, the ink pathway provided therein and the heat management system connected thereto. These simplifications would lower costs and improve reliability of the printer.

While U.S. Pat. No. 4,369,456 utilizes a stationary printhead, the system does not enable a plurality of maintenance station functions to be performed at a single stationary position of the printhead. Furthermore, the cleaning belt is positioned between the printhead and paper handling system which could result in interference with a printing operation and require additional spacing between the printhead and paper handling system.

OBJECTS AND SUMMARY OF THE INVENTION

It is an object of the present invention to provide a maintenance system which can perform a plurality of maintenance operations on a printhead without moving the printhead.

It is another object of the present invention to provide a printhead maintenance system which can perform maintenance operations on a printhead while the printhead is in its printing position.

It is another object of the present invention to provide a maintenance system for a full width printhead without requiring movement of the printhead or the paper handling system.

It is a further object of the present invention to provide a maintenance system for an ink jet printhead which can perform multiple operations on a full width printhead such as priming, capping-spitting, wiping and single-jet priming without requiring any special movement of the printhead or the paper handling system.

To achieve the foregoing and other objects, and to overcome the shortcomings discussed above, an ink jet printer having a paper handling and maintenance station assembly is provided. The ink jet printer according to the present invention includes a paper conveying apparatus having a paper handling loop, the loop defining a substantially enclosed area. A maintenance station is movably positioned within this area. The loop has at least one opening which provides periodic access by the maintenance station to a printhead positioned exterior to the loop enclosed area. The maintenance station can move up to and away from the opening in the loop. The maintenance station is further rotatably positioned within this area. The circumference of the maintenance station includes a plurality of members, each member performing a different maintenance function. The maintenance station can therefore be selectively positioned to engage a stationary printhead.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
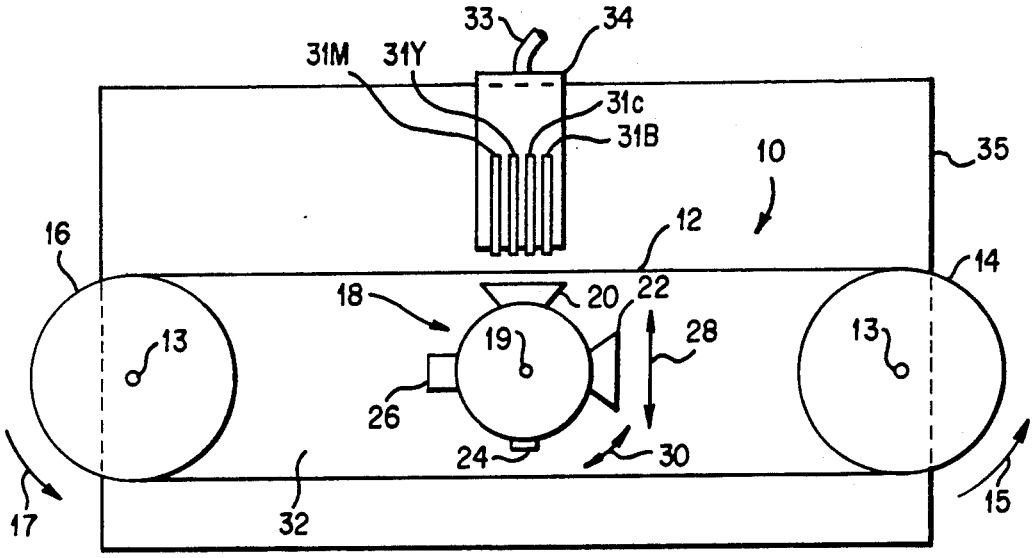
FIG. 1 is a side plan view of a paper handling and maintenance station assembly used with an ink jet printer having a web driven by rotatable shafts.

Referring now to the drawings, and particularly to FIG. 1 thereof, there is shown in accordance with a preferred embodiment of the present invention a paper handling and maintenance station assembly 10 used in an ink jet printer. As shown, ink is supplied to a printhead 34 through an ink supply line 33. When the printhead is a full width, i.e. pagewidth, printhead, the printhead is held in a fixed position by printer assembly support means 35. Printer assembly support means 35 can be, for example, a frame to which printhead 34 and paper handling and maintenance assembly 10 are attached. Printer assembly support means 35 could then be mounted in the printer body (not shown). Alternatively, separate frames could be used to support printhead 34 and paper handling and maintenance assembly 10 or these components could be attached directly to the printer body. When the printhead used is a carriage-type printhead, the printhead is mounted to move back and forth across a page on a carriage 37 (see FIG. 3). Carriage 37 could be slidably mounted on a track (not shown) which is also attached to printer assembly support means 35.

A paper conveying means comprising a supply roll 14 and a takeup roll 16 having a flexible endless web 12 positioned thereabout is shown in FIG. 1. This conveying means operates to properly position papers on which the ink is to be deposited directly beneath and closely adjacent to the front face of the printhead 34. The closeness of printhead 34 to the is critical because ink drop placement accuracy decreases with increased distance between printhead 34 and the paper.

The web 12 defines an area 32 which is substantially enclosed by the web. Within area 32 is a centrally located maintenance station 18. Maintenance station 18 is movably positioned within area 32. Maintenance station 18 is movable in the directions indicated by arrows 28 and 30. Maintenance station 18 is supported at member 19 and includes, on the periphery of the station, at least one maintenance member selected from a printhead priming station 20, a capping-spitting station 22, a nozzle wiping blade 24 and a sliding single jet priming station 26. Rotation in the directions indicated by arrows 30 enables selection of any of the maintenance members provided on the surface of the maintenance station.

Printhead priming station 20 functions to remove any undesirable non-collapsing air bubbles which may exist from all of the nozzles contained in printhead 34. Printhead priming station 20 would primarily be used when bubbles exist in many of the nozzles (for example, at start-up) and is capable of priming all four rows of nozzles 31M, 31Y, 31C and 31B (magenta, yellow, cyan and black, respectively) in the four-color printhead illustrated in FIG. 1. Capping-spitting station 22 is used after priming to clear excess ink from nozzles 31 and to cap the nozzles during non-use and provide a high-humidity environment to prevent ink in the nozzles from drying during non-use. Nozzle wiping blade 24 is used to wipe the nozzle-containing surface of printhead 34 to remove contaminants such as ink and dirt therefrom which tend to adversely affect print quality. Nozzle wiping blade 34 can be, for example, a rubber blade which wipes across the nozzle-containing surface of printhead 34 as maintenance station 18 rotates. Sliding single jet priming station 26 traverses the length of maintenance station 18 and is used to prime individual nozzles which develop non-collapsing air bubbles therein during the course of a printing operation. Sliding single jet priming station 26 can be manually actuated, for example when an operator visually detects poor print quality, but is preferably automatically activated when the printer detects the existence of non-collapsing air bubbles in one or more nozzles.

Figure 2:
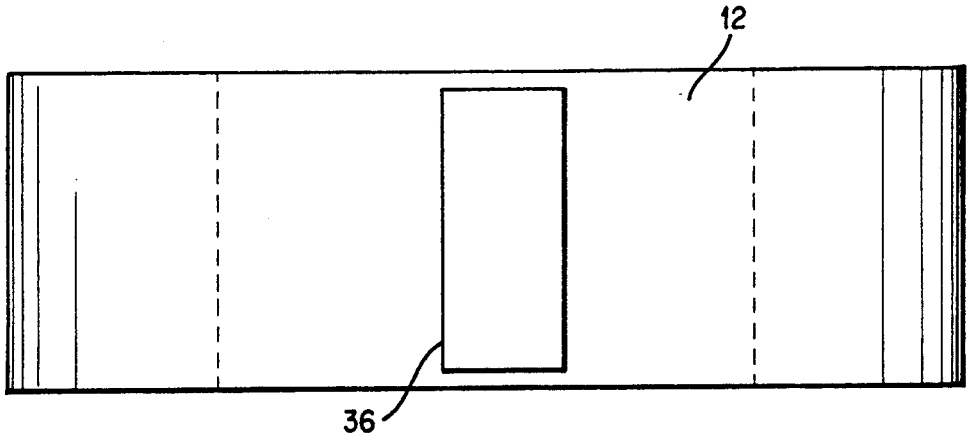
FIG. 2 is a top plan view of the paper handling system of FIG. 1.

As shown in FIG. 2, the flexible web 12 includes an opening 36. This opening provides access by the maintenance station 18 to the front face of the printhead 34. Upon direct positioning of opening 36 beneath the front face of printhead 34, the maintenance station 18 is moved upwardly in the direction indicated by arrow 28. Upward movement of the maintenance station enables the selected station member to contact the printhead and perform its maintenance function thereon. Upon completion of the maintenance service, the maintenance station 18 is moved downwardly in the direction indicated by arrow 28, and the printing process is resumed. Thus, the present invention permits multiple maintenance operations to be performed on a printhead without moving the printhead to a special position and without moving printhead 34 and paper conveying means apart from each other.

Figure 3:
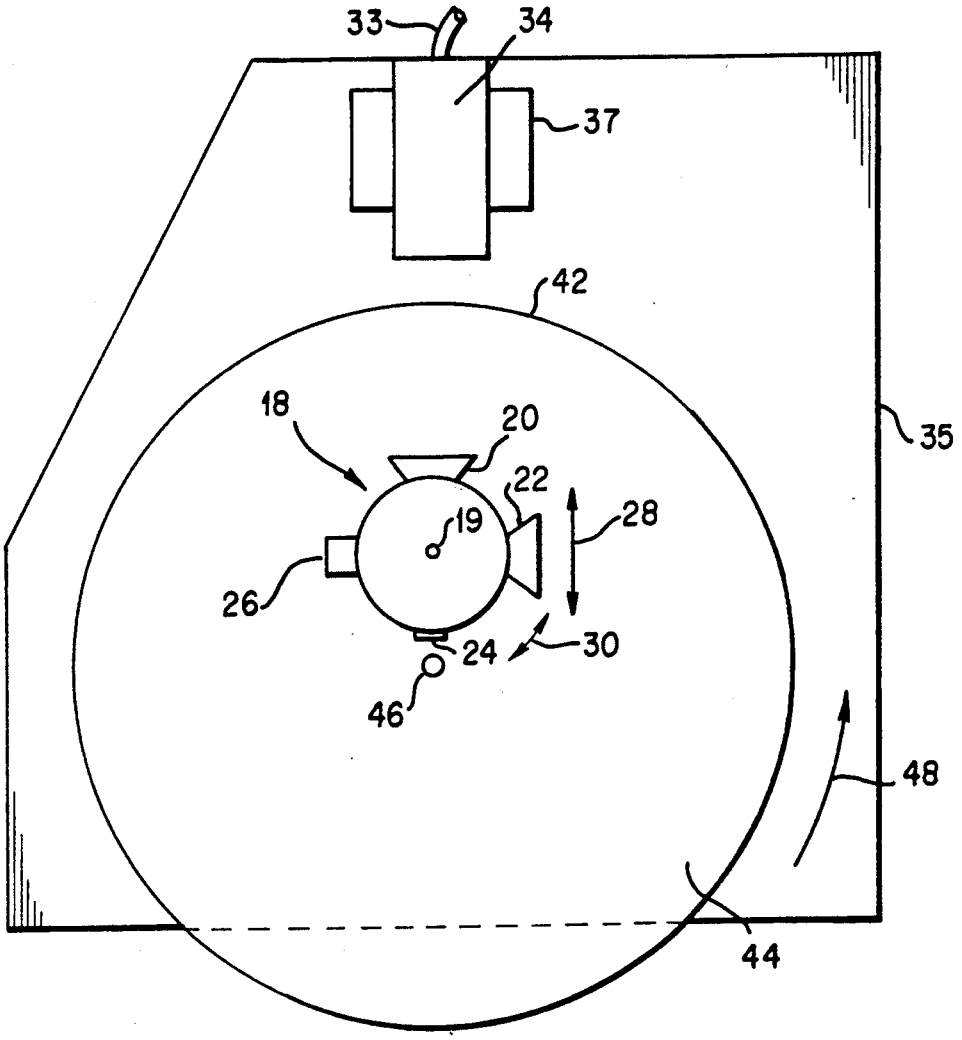
FIG. 3 is a side plan view of a paper handling and maintenance station assembly used with an ink jet printer having a paper handling assembly which includes a drum.

FIG. 3 illustrates a paper handling and maintenance station assembly used with an ink jet printer having a drum 42 which functions as the paper conveying member. The printhead 34 shown in FIG. 3 is mounted on a carriage 37 which slidably traverses the width of a page. Drum 42 rotates about shaft 46 in the direction indicated by arrow 48. On the surface of drum 42 is provided the paper on which the ink from printhead 34 is deposited. The drum defines a substantially enclosed area 44 in which is positioned maintenance member 18 as previously described with respect to FIG. 1.

Figure 4:
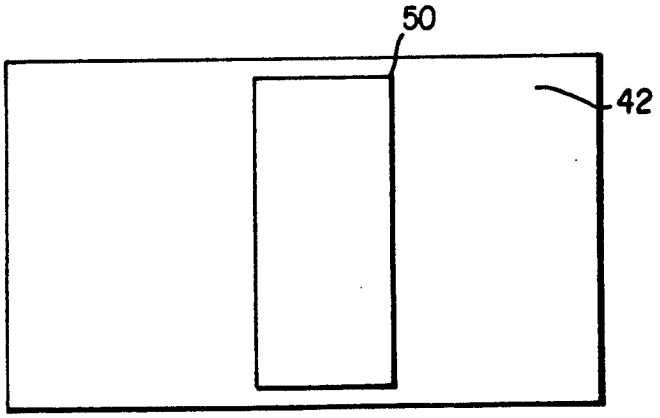
FIG. 4 is a top plan view of the paper handling system of FIG. 3.

As shown in FIG. 4, the outer surface of drum 42 includes an opening 50 which, like opening 36 of FIG. 2, provides access by the selected member of maintenance station 18 to the front face of printhead 34.

Rotatable maintenance station 18 in accordance with the present invention can be used in any ink jet printing apparatus. When a carriage-type printer is used, maintenance station 18 could further be placed at a position along side of the printing area, as in the above-mentioned U.S. Pat. No. 4,144,537, and the printhead could be moved to this position for performance of the selected maintenance function. Alternatively, as shown in FIG. 3, the maintenance station could access the carriage-type printhead through an opening in the paper handling assembly. An advantage of access through an opening in the paper handling assembly is that the printhead would never have to be moved out of the printing position, thus reducing the amount of space required by the carriage-moving assembly.

While this invention has been described in conjunction with specific embodiments thereof, it is evident that many alternatives, modifications and variations will be apparent to those skilled in the art. For example, when combined with a paper conveying means which includes an opening, maintenance station need not be rotatable as long as one or more maintenance members can be selectively engaged with the printhead by movement through the opening. Accordingly, the preferred embodiments of the invention as set forth herein are intended to be illustrative, not limiting. Various changes may be made without departing from the spirit and scope of the invention as defined in the following claims.

What is claimed is:

1. A paper handling and maintenance station assembly for use with an ink jet printhead, said assembly comprising:

a paper-conveying means including a paper-handling loop, said loop defining an area substantially enclosed by said loop;

a maintenance station movably positioned within said area enclosed by said loop, said maintenance station including at least two members selected from a printhead priming station, a capping-spitting station, a nozzle wiping blade and a sliding single-jet priming station, each member being positioned about a circumference of said maintenance station; and at least one opening in said loop, said opening providing periodic access by said maintenance station to a printhead adapted to be positioned exterior to said loop-enclosed area.

2. The paper handling and maintenance station assembly as recited in claim 1, wherein:

said maintenance station is rotatably positioned within said loop-enclosed area, rotation of said maintenance station causing a selected one of said members to be presented to said opening.

3. The paper-handling and maintenance station assembly as recited in claim 2, wherein:

said maintenance station is movable in an axial direction within said area enclosed by said loop, axial movement of said maintenance station resulting in the positioning of a portion of said maintenance station into or removed from said opening in said loop.

4. The paper handling and maintenance station assembly as recited in claim 1, wherein:

said paper-handling loop comprises a flexible endless web positioned about two spaced rollers, one roller comprising a supply roll and the other roller comprising a take-up roll, movement of the rollers causing rotation of said web.

5. The paper handling and maintenance station assembly as recited in claim 1, wherein:

said paper-handling loop is the outer circumferential surface of a drum, said drum being attached to a rotatable shaft, rotation of the shaft causing rotation of said loop.

6. The paper-handling and maintenance station assembly as recited in claim 1, wherein:

said maintenance station is movable in an axial direction within said area enclosed by said loop, axial movement of said maintenance station resulting in the positioning of a portion of said maintenance station into or removed from said opening in said loop.

7. An ink jet printer for printing on a recording medium comprising:

paper-conveying means including a paper-handling loop;

a full-width ink jet printhead;

a printer assembly support means fixing said paper-handling loop and said printhead in close proximity to one another;

said loop defining an area substantially enclosed by said loop;

a maintenance station connected to said printer assembly support means, said maintenance station being movably positioned within said loop-enclosed area, said maintenance station including at least two members selected from a printhead priming station, a capping-spitting station, a nozzle wiping blade and a sliding single-jet primary station, each member being positioned about a circumference of said maintenance station; and at least one opening in said loop, said opening providing periodic access by said maintenance station to the printhead, said printhead being positioned exterior to the loop-enclosed area.

8. The ink jet printer as recited in claim 7, wherein:

said maintenance station is rotatably positioned within said loop-enclosed area, rotation of said maintenance station causing a selected one of said members to be presented to said opening.

9. The ink printer as recited in claim 8, wherein:

said maintenance station is movable in an axial direction within said loop-enclosed area, axial movement of said maintenance station resulting in the positioning of said maintenance station into or removed from said opening in said loop.

10. The ink printer as recited in claim 7, wherein:

said paper-handling loop comprises a flexible endless web positioned about two spaced rollers, one roller comprising a supply roll and the other roller comprising a take-up roll, movement of the rollers causing rotation of said web.

11. The ink printer as recited in claim 7, wherein:

said paper-handling loop is the outer circumferential surface of a drum, said drum being attached to a rotatable shaft, rotation of the shaft causing rotation of said loop.

12. The ink printer as recited in claim 7, wherein:

said maintenance station is movable in an axial direction within said loop-enclosed area, axial movement of said maintenance station resulting in the positioning of said maintenance station into or removed from said opening in said loop.

13. An ink jet printer for printing on a paper medium comprising:

a paper-conveying means including a paper-handling loop;

an ink jet printhead;

a printer assembly support means positioning said ink jet printhead close to said paper-handling loop;

a maintenance station rotatably mounted on said printer assembly support means;

said maintenance station including at least two members selected from a printhead priming station, a capping-spitting station, a nozzle wiping blade and a sliding single-jet priming station, each member positioned about a circumference of said maintenance station;

at least one of said printhead and said maintenance station being movably positioned with respect to the other of said printhead and said maintenance station, said movement providing contact between said printhead and said maintenance station; and rotation of said maintenance station presenting a selected one of said members to said printhead.

14. The ink jet printer as recited in claim 13, wherein:

said paper-handling loop defines an area which is substantially enclosed by said loop;

said loop having at least one opening therein providing communication between the interior and the exterior of said loop-enclosed area;

said maintenance station being movably positioned within the loop-enclosed area in an axial direction, the axial movement of said maintenance station resulting in the positioning of said maintenance station into or removed from said opening in said loop;

said printhead being positioned exterior to said loop-enclosed area.

15. The ink jet printer as recited in claim 14, wherein:

the ink jet printhead is supported on a movable carriage.

16. The ink jet printer as recited in claim 14, wherein:

the ink jet printhead is a full width printhead which is stationarily mounted to said printer.

17. The ink jet printer as recited in claim 13, wherein:

the ink jet printhead is supported on a movable carriage.

18. The ink jet printer as recited in claim 13, wherein:

the ink jet printhead is a full width printhead which is stationarily mounted to said printer.

19. The ink jet printer as recited in claim 13, wherein:

said paper-handling loop comprises a flexible endless web positioned about two spaced rollers, one roller comprising a supply roll and the other roller comprising a take-up roll, movement of the rollers causing rotation of said web.

20. The jet printer as recited in claim 13, wherein:

said paper-handling loop is the outer circumferential surface of a drum, said drum being attached to a rotatable shaft, rotation of the shaft causing rotation of said loop.

* * * * *